United States Patent [19]

Higashio et al.

[11] Patent Number: 4,885,611

[45] Date of Patent: Dec. 5, 1989

[54] MULTICOLOR IMAGE FORMING APPARATUS

[75] Inventors: Kimihiko Higashio; Kadotaro Nishimori, both of Osaka, Japan

[73] Assignee: Minolta Camera Kabushika Kaisha, Osaka, Japan

[21] Appl. No.: 158,940

[22] Filed: Feb. 22, 1988

[30] Foreign Application Priority Data

Feb. 26, 1987 [JP] Japan ..... 62-44453

[51] Int. Cl.[4] ..... G03G 15/000; G03G 15/01; G03G 15/085

[52] U.S. Cl. ..... 355/245; 355/328

[58] Field of Search ..... 355/14 D, 4, 3 DD, 3 R, 355/14 R

[56] References Cited

U.S. PATENT DOCUMENTS

| | | | |
|---|---|---|---|
| 3,914,043 | 10/1975 | McVeigh | 355/4 |
| 3,960,445 | 6/1976 | Drawe | 355/4 X |
| 3,967,891 | 7/1976 | Rippstein | 355/3 R |
| 4,099,860 | 7/1978 | Connin | 355/14 R |
| 4,346,982 | 8/1982 | Nakajima et al. | 355/3 R |
| 4,572,102 | 2/1986 | Yuge et al. | 355/14 D |
| 4,619,514 | 10/1986 | Ide | 355/3 R |
| 4,634,259 | 1/1987 | Oishi et al. | 355/4 |
| 4,657,376 | 4/1987 | Ide | 355/14 R |
| 4,659,211 | 4/1987 | Oka | 355/14 D |
| 4,666,288 | 5/1987 | Watanabe | 355/14 R |
| 4,690,543 | 9/1987 | Watanabe | 355/14 D |
| 4,710,016 | 12/1987 | Watanabe | 355/14 D |
| 4,720,730 | 1/1988 | Ito | 355/14 D |
| 4,723,148 | 2/1988 | Hamakawa | 355/14 SH |
| 4,728,985 | 3/1988 | Nakashima et al. | 355/7 |
| 4,740,811 | 4/1988 | Watanabe | 355/61 |
| 4,743,945 | 5/1988 | Ito et al. | 355/14 SH |
| 4,743,946 | 5/1988 | Nishimori et al. | 355/14 C |
| 4,745,437 | 5/1988 | Oka et al. | 355/14 CH |
| 4,746,954 | 5/1988 | Matuura et al. | 355/14 D |
| 4,754,301 | 6/1988 | Kasamura et al. | 355/14 D |
| 4,772,921 | 9/1988 | Ito | 355/14 SH |

FOREIGN PATENT DOCUMENTS

| | | |
|---|---|---|
| 48-22212 | 7/1973 | Japan . |
| 51-134635 | 11/1976 | Japan . |
| 54-30833 | 3/1979 | Japan . |
| 60-170868 | 9/1985 | Japan . |
| 61-72270 | 4/1986 | Japan . |
| 61-203474 | 9/1986 | Japan . |

*Primary Examiner*—R. L. Moses

*Attorney, Agent, or Firm*—Burns, Doane, Swecker & Mathis

[57] ABSTRACT

An image forming apparatus equipped with a plurality of developing units respectively using different color toners, and capable of forming a two-color image. The image forming apparatus is able to operate selectively in a first image forming mode for forming a single-color image, and in a second image forming mode for forming a two-color image. In the second image forming mode, sections of a latent image respectively corresponding to previously demarcated sections of the contact glass are developed in two different colors by operating the two developing units in an appropriate sequence. Selection of the second image forming mode is inhibited and an alarm signal is provided when only one of the plurality of developing units is mounted in place on the frame of the image forming apparatus.

13 Claims, 14 Drawing Sheets

MULTICOLOR IMAGE FORMING APPARATUS

BACKGROUND OF THE INVENTION

The present invention relates generally to an electrophotographic image forming apparatus, such as a copying machine or a printer, and, more specifically, to a multicolor image forming apparatus having a plurality of developing units respectively using different color toners, and capable of forming two-color images.

An image forming apparatus having a plurality of developing units respectively using different color toners and removably arranged around an electrostatic latent image carrying member has been put to practical use. This image forming apparatus, however, simply forms a single-color image by selectively operating one of the plurality of developing units.

In U.S. patent application Ser. No. 120,595 (Filed on Nov. 13, 1987), the inventors of the present invention have proposed a two-color image forming apparatus capable of forming two-color images by operating two developing units in a timed relation. The two developing units of this two-color image forming apparatus need to be disposed respectively at predetermined positions. Otherwise the two-color image forming apparatus is unable to form a desired two-color image even when a two-color image forming mode is selected.

SUMMARY OF THE INVENTION

Accordingly, it is a principal object of the present invention to provide a multicolor image forming apparatus provided with a plurality of developing units.

It is another object of the present invention to provide a multicolor image forming apparatus provided with a plurality of developing units and capable of selectively operating in an image forming mode using the plurality of developing units.

The above and other objects, features and advantages of the present invention will become apparent from the following description taken in conjunction with the accompanying drawings.

DETAILED DESCRIPTION OF THE PREFERRED EMBODIMENTS

An image forming apparatus, in a preferred embodiment, according to the present invention will be described hereinafter with reference to the accompanying drawings.

Figure 1:
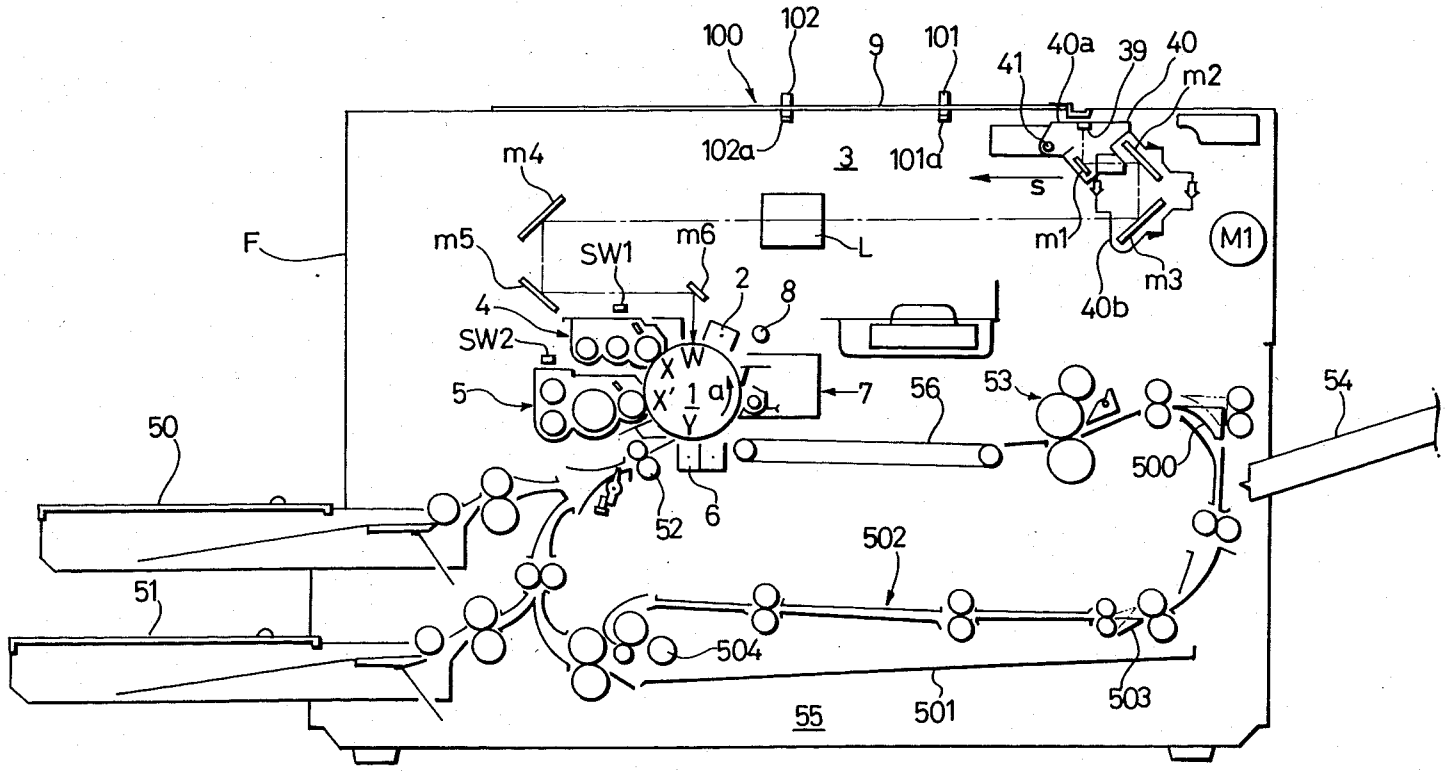
FIG. 1 is a schematic side elevation of an image forming apparatus, in a preferred embodiment, according to the present invention.
Figure 2:
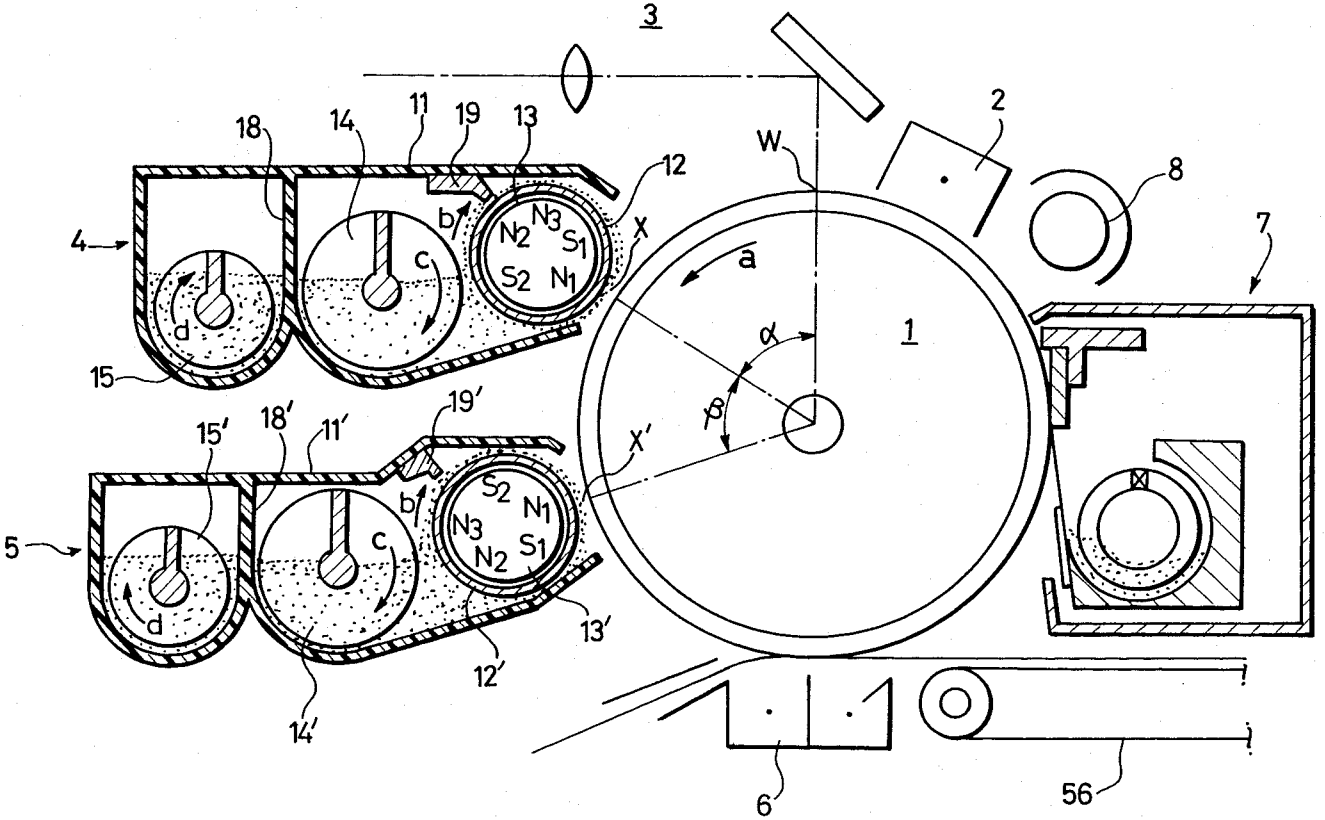
FIG. 2 is a fragmentary sectional view showing a portion of the image forming apparatus of FIG. 1 including a photosensitive drum, developing units and the associated components.

Constitution and Function of Image Forming Apparatus (FIG. 1)

The general constitution of the image forming apparatus and a standard copying operation for reproducing the intact image of a document.

Referring to FIG. 1, a photosensitive drum 1 is supported rotatably substantially in the central portion of a frame F of an image forming apparatus. While the photosensitive drum 1 is rotated in the direction of an arrow a, the circumference of the photosensitive drum 1 is charged uniformly in a fixed charge by a charger 2.

An optical scanning system 3 comprises a first scanning unit 40*a* having an exposure lamp 41 and a first mirror m1, a second scanning unit 40*b* having a second mirror m2 and a third mirror m3, a lens L, a fourth mirror m4, a fifth mirror m5, and a sixth mirror m6. The first scanning unit 40*a* moves in the direction of an arrow s at a speed V/n, where V is the circumferential speed of the photosensitive drum 1, and n is copying magnification. The second scanning unit 40*b* moves in the direction of the arrow b at a speed V/2n. The scanner 40 consisted of scanner 40*a* and 40*b* is driven by a scanning motor, not shown.

During the scanning operation of the optical scanning system, a document placed on a contact glass 9 is illuminated, reflected light reflected by the document is transmitted by the mirrors and the lens of the optical scanning system and is projected at an exposure position W on the circumference of the photosensitive drum 1 for exposure to form an electrostatic latent image of the image of the document over the circumference of the photosensitive drum 1. Toner is applied to the electrostatic latent image in a developing zone X opposite a first developing unit 4 or in a developing zone X' opposite a second developing unit 5 to develop the electrostatic latent image in a corresponding toner image representing the image of the document.

On the other hand, a copying sheet is supplied selectively by a sheet feed unit 50 or 51. Then, a timing roller 52 delivers the copying sheet in synchronism with the rotation of the photosensitive drum 1 to a transfer zone Y opposite a transfer charger 6 so that the toner image is transferred from the circumference of the photosensitive drum 1 to the copying sheet at an appropriate position thereon in the transfer zone Y. Then, a conveyor belt 56 conveys the copying sheet to a fixing unit 53, in which the toner image is fused and fixed to the copying sheet, and then the copying sheet is discharged to a delivery unit 54.

When a two-side or composite copying mode is selected, a guide plate 500 is shifted from a position indicated by solid lines to a position indicated by dotted lines to guide the copying sheet carrying the toner image on one side thereof to a refeeding unit 55. When the two-side copying mode is selected, the copying sheet carrying the toner image on one side thereof is delivered through an inverting path 502 to an intermediate tray 501 in an inverted position. When the composite copying mode is selected, a guide plate 503 is shifted from a position indicated by solid lines to a position indicated by dotted lines to deliver the copying sheet directly to the intermediate tray 501. The copying sheet contained in the intermediate tray 501 is refed to the transfer zone Y by a refeed roller 504, while the photosensitive drum 1 and the optical scanning system 3 execute the second copying cycle to form another image on the backside of the copying sheet when the two-side copying mode is selected or to form another image on the front side of the copying sheet when the composite copying mode is selected.

After the toner image formed over the circumference of the photosensitive drum 1 has been transferred to the copying sheet, a cleaning unit 7 removes residual toner from the circumference of the photosensitive drum 1 and an eraser lamp 8 erases residual charge from the circumference of the photosensitive drum 1 by illuminating the circumference of the photosensitive drum 1 to prepare the photosensitive drum 1 for the next copying cycle.

The image forming apparatus is capable of operating in a two-color image forming mode for forming a two-color image in addition to operating in the standard image forming mode. In the two-color image forming mode, the first developing unit 4 and the second developing unit 5 with a time lag in one scanning cycle of the scanner 40. The image forming apparatus is provided with an image sectioning mechanism 100 and a special mechanism for the first developing unit 4 and the second developing unit 5 for the two-color image forming operation.

Constitution and Function of Developing Units (FIGS. 2 to 7)

First, the constitution of the first developing unit 4 and the second developing unit 5 will be described. The first developing unit 4 and the second developing unit 5 are mounted removably on the frame F. As obvious from FIG. 2, the first developing unit 4 and the second developing unit 5 are substantially the same in constitution and hence only the constitution of the first developing unit will be described.

A developing sleeve 12, a supply roller 14 and a screw 15 are arranged in a developer tank 11 in that order from one side near the photosensitive drum 1 to the other side remote from the photosensitive drum 1. The developer tank 11 of the first developing unit 4 contains a color developer consisting of a magnetic carrier and color toner, and the developer tank 11' of the second developing unit 5 contains a black developer consisting of a magnetic carrier and black toner. The developing sleeve 12 is a nonmagnetic, conductive cylindrical member. The circumference of the developing sleeve 12 is finished by sand blasting to form minute irregularities therein. The developing sleeve 12 is disposed opposite to the photosensitive drum 1 with a developing gap Ds forming the developing zone X therebetween. The angles of rotation of the photosensitive drum 1 from the exposure position W to the developing zone X and from the exposure position W to the developing zone X' respectively for the first developing unit 4 and the second developing unit 5 are $\alpha$ and $\alpha+\beta$. A brush height regulating member 19 is disposed behind the developing sleeve 12, namely, on one side of the developing sleeve remote from the developing zone X, with a gap Db between the brush height regulating member 19 and the circumference of the photosensitive drum 1. The developing sleeve 12 is provided internally with a magnet roller 13 having a plurality of axially extending magnets respectively having magnetic poles $N_1$, $N_2$, $N_3$, $S_1$ and $S_2$ on the circumference of the magnet roller 13. Magnetic flux densities at the magnetic poles $N_1$, $N_2$, $N_3$, $S_1$ and $S_2$ are 1000G, 500G, 500G, 800G and 800G, respectively.

Figure 4:
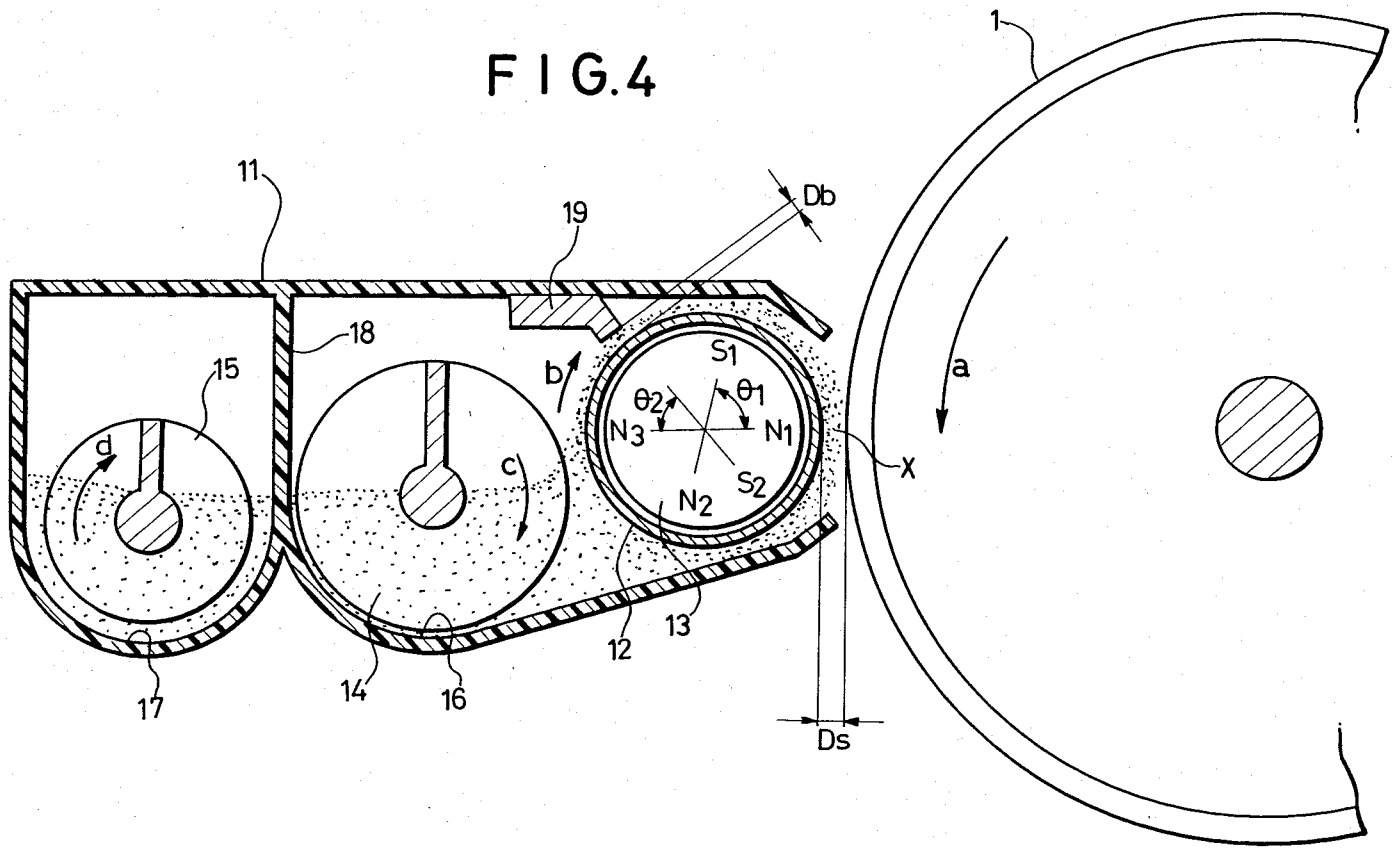
FIGS. 4 and 6 are fragmentary sectional views of assistance in explaining the manner of operation of the developing unit of FIG. 3.

Referring to FIG. 4, the circumferential order of arrangement of the magnetic poles with respect to a clockwise direction is $N_1$, S $N_2$, $N_3$ and $S_1$. The angular distance between the center of the magnetic pole $N_1$ and the center of the magnetic pole $S_1$ is $\theta_1$ (in this embodiment, 80°). When the magnetic pole $N_1$ is located opposite to the photosensitive drum 1, the center of the magnetic pole $N_3$ is located at an angular distance of $\theta_2$ (in this embodiment, 40°) from the brush height regulating member 19 in a counterclockwise direction.

Figure 3:
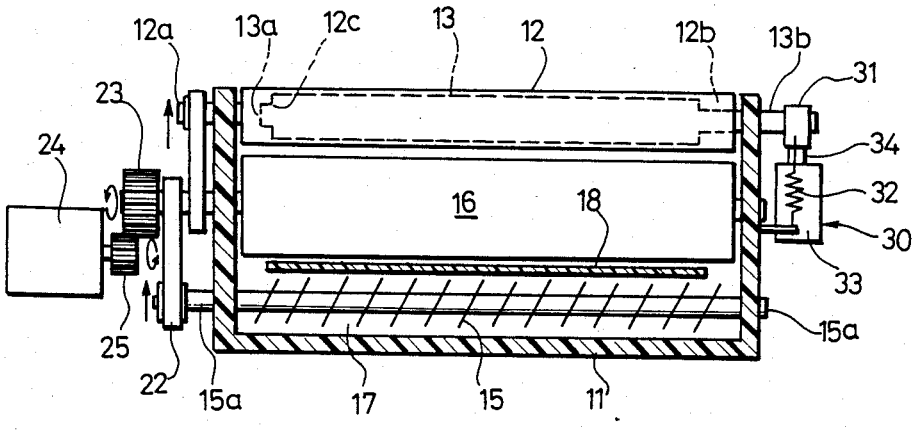
FIG. 3 is a longitudinal sectional view of a developing unit employed in the image forming apparatus of FIG. 1.

As shown in FIG. 3, the magnet roller 13 has one pivotal shaft **13*a* supported in a bearing recess 12*c* formed within the developing sleeve 12 and the other pivotal shaft 13*b* supported on the side wall of the developing tank 11. The magnet roller 13 can be turned through a predetermined angle $\theta_2$ (in this embodiment, 40°) by a magnet roller turning mechanism 30, which will be described afterward. The developing sleeve 12 has one pivotal shaft 12*a* on the left-hand end thereof, as viewed in FIG. 3, journaled on the side wall of the developing tank 11 and another pivotal shaft 12*b* on the right-hand end thereof, as viewed in FIG. 3, journaled on the pivotal shaft 13*b* of the magnet roller 13. The developing sleeve 12 can be driven for rotation by a driving mechanism 20**.

The developing tank 11 is partitioned by a partition wall 18 into chambers 16 and 17. The supply roller 14 and the screw 15 are disposed respectively within the chambers 16 and 17 and are journaled on the side walls of the developing tank 11 so as to be driven by the driving mechanism 20. The chambers 16 and 17 communicates with each other at the opposite ends of the developing tank 11 as shown in FIG. 3.

Referring again to FIG. 3, the driving mechanism 20 for driving the developing sleeve 12, the supply roller 14 and the screw 15 comprises a belt 1 extended between the pivotal shaft **12*a* of the developing sleeve 12 and the pivotal shaft 14*a* of the supply roller 14, a belt 22 extended between the pivotal shaft 14*a* of the supply roller 14 and the pivotal shaft 15*a* of the screw 15, a driven gear 23 mounted on the pivotal shaft 14*a* of the supply roller 14, a driving gear 25 engaging the driven gear 23 and mounted on the output shaft of a motor 24. When the motor 24 is driven to rotate the driving gear 25 in a direction indicated by an arrow in FIG. 3, the driven gear 23 is rotated and the belts 21 and 22 are caused to run respectively in directions indicated by arrows. Consequently, the developing sleeve 12, the supply roller 14 and the screw 15 are rotated respectively in directions indicated by arrows b, c and d in FIG. 2**.

Figure 5:
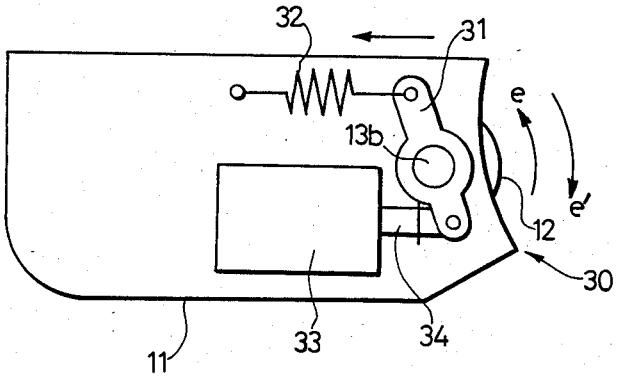
FIGS. 5 and 7 are schematic front elevations of a magnet roller shifting mechanism employed in the image forming apparatus of FIG. 1.
Figure 7:
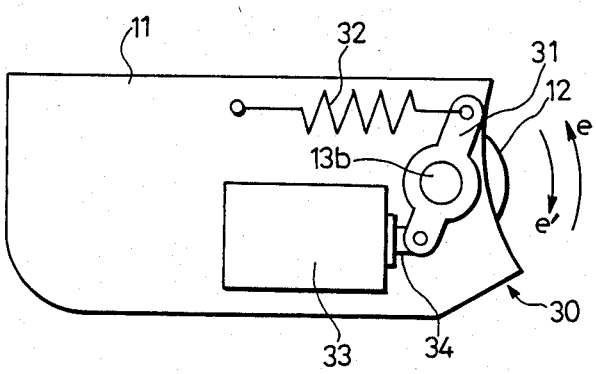
Figure 6:
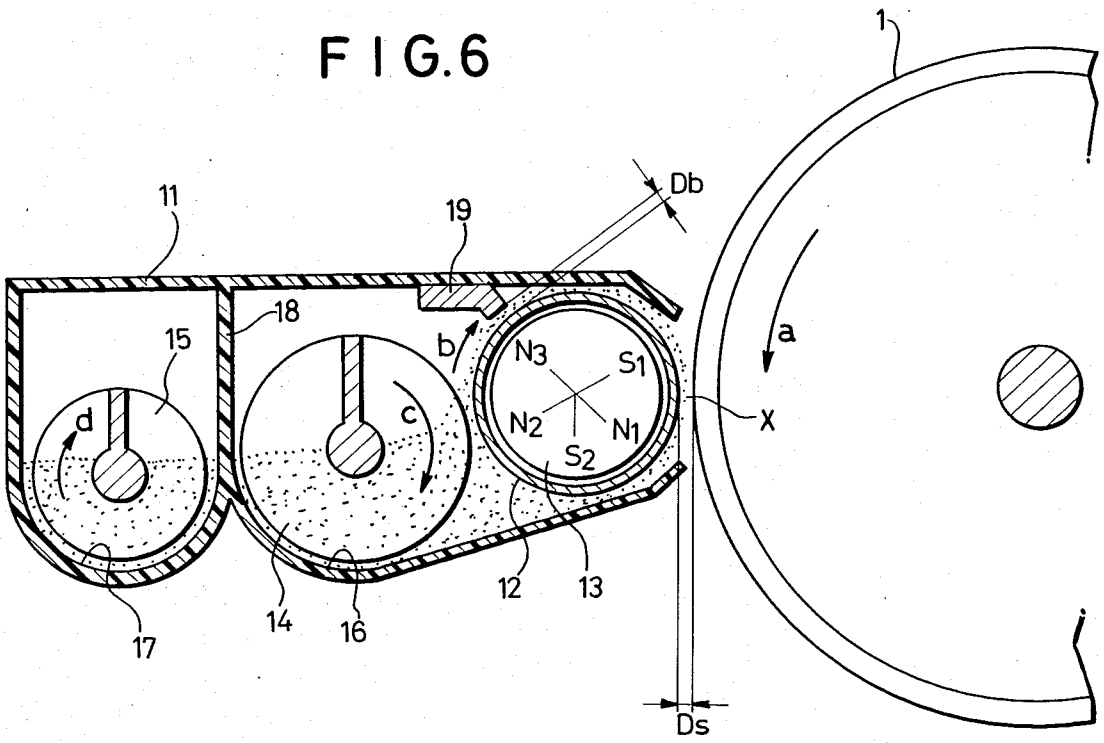

Referring to FIGS. 5 and 7, the magnet roller turning mechanism 30 comprises a lever 31, a tension spring 32 and a solenoid 33. The lever 31 is fixedly mounted on the pivotal shaft 13b of the magnet roller 13. The tension spring 32 has one end connected to one end of the lever 31 and the other end connected to the developing tank 11 to bias the lever 31 always in a direction indicated by an arrow e. The other end of the lever 31 is connected to a plunger 34 operatively associated with the solenoid 33. When the solenoid 33 is energized, the lever 31 is turned in a direction indicated by an arrow e' against the resilient force of the tension spring 32. While the solenoid 33 is not energized, namely, when the lever 31 is located at a position shown in FIG. 5, the magnetic pole $N_1$ of the magnet roller 13 is located opposite to the photosensitive drum 1, and the magnetic pole $N_3$ of the same is located at the angular distance $\theta_2$ (40°) in a counterclockwise direction from the brush height regulating member 19 as shown in FIG. 4. When the solenoid 33 is energized to locate the lever 31 at a position shown in FIG. 7, the magnetic pole $N_3$ is located opposite to the brush height regulating member 19 and the middle position between the magnetic poles $N_1$ and $S_1$ is located opposite to the photosensitive drum 1 as shown in FIG. 6.

The developing units 4 and 5 are provided removably respectively at fixed positions as shown in FIG. 1. Removal and setting of the developing units 4 and 5 are detected respectively by developing unit detecting switches SW1 and SW2. Magnets are fixed to the upper surfaces of the respective developing tanks 11 and 11' of the developing units 4 and 5 to selectively turn on reed switches SW3 to SW8 provided on the frame of the image forming apparatus opposite to the magnets to identify the developing units 4 and 5, which use developers of different colors, respectively.

Figure 8:
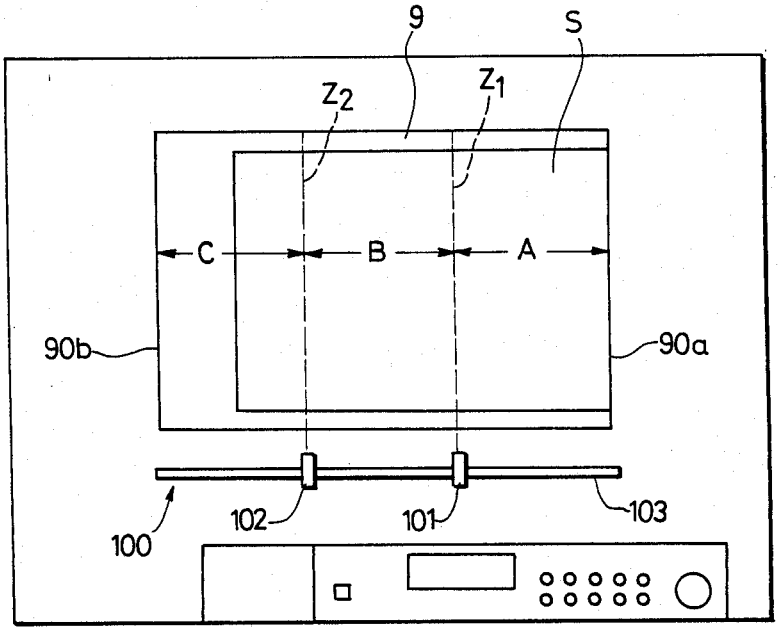
FIG. 8 is a plan view of an image sectioning mechanism employed in the image forming apparatus of FIG. 1.
Figure 9:
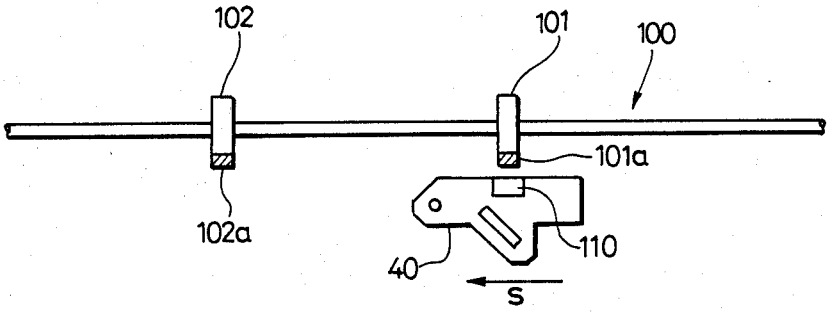
FIG. 9 is a front elevation of the image sectioning mechanism of FIG. 8.

Image Sectioning Mechanism (FIGS. 8 and 9)

Referring to FIGS. 8 and 9, the image sectioning mechanism 100 has a first slider 101 and a second slider 102 for demarcating sections in the document supporting surface of the contact glass 9 divided along the scanning direction of the scanner 40 indicated by the arrow s and for designating colors for the reproduced image. The sliders 101 and 102 are slidable along a guide groove 103 formed on one side of the contact glass 9 along the scanning direction of the scanner 40 Magnets 101a and 102a are attached to the respective lower ends of the sliders 101 and 102 within the housing of the image forming apparatus.

When the sliders 101 and 102 are set respectively at positions as shown in FIG. 8, the sliders 101 and 102 define, on the surface of the contact glass 9, a section A between the front end 90a of the contact glass 9 and the first slider 101, a section B between the first slider 101 and the second slider 102, and a section C between the second slider 102 and the rear end 90b of the contact glass, and specify reproducing colors for the sections A, B and C, for example, black for the sections A and C, and a chromatic color for the section B.

Figure 11:
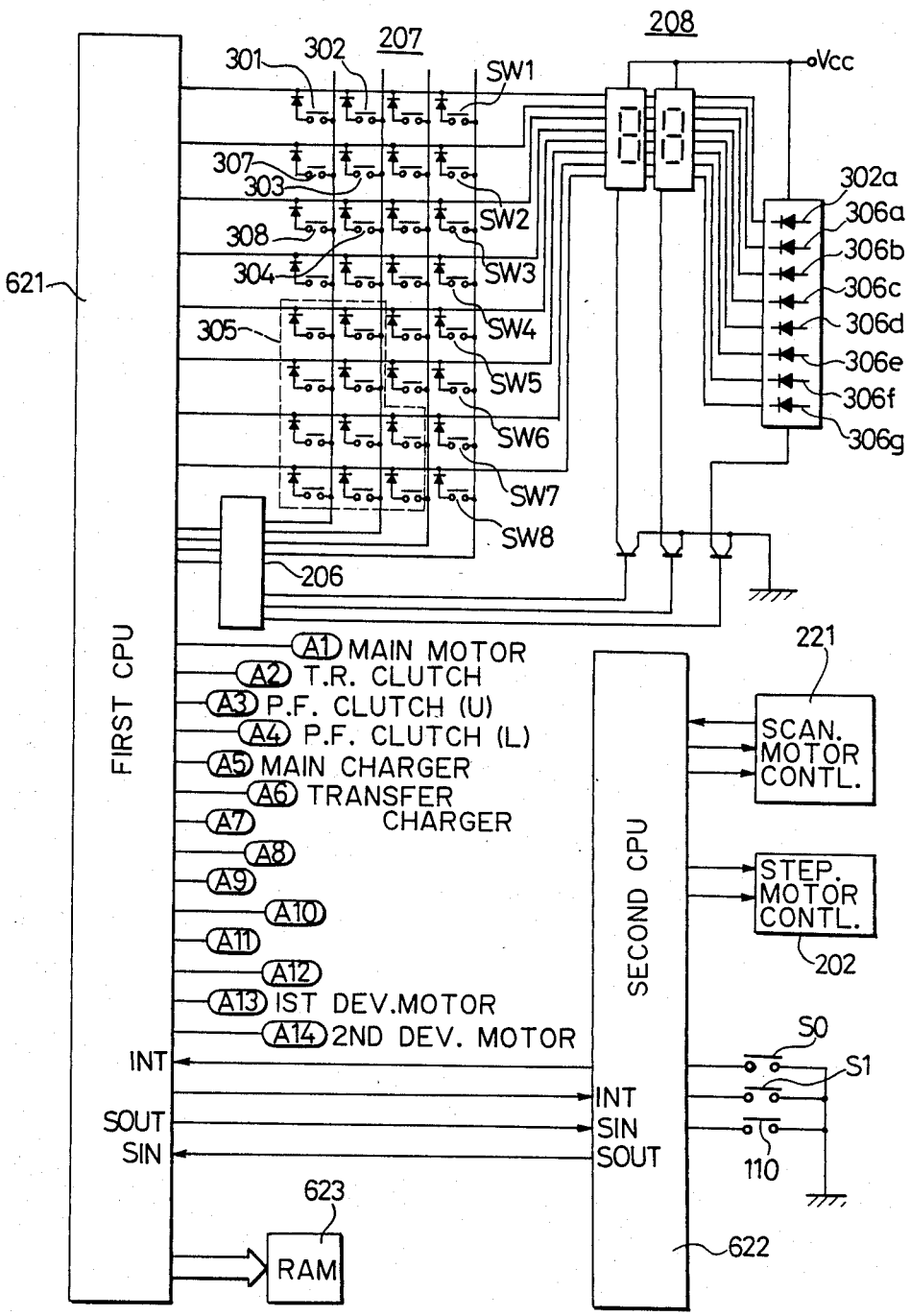
FIG. 11 is a block diagram of a control circuit incorporated into the image forming apparatus of FIG. 1.
Figure 12:
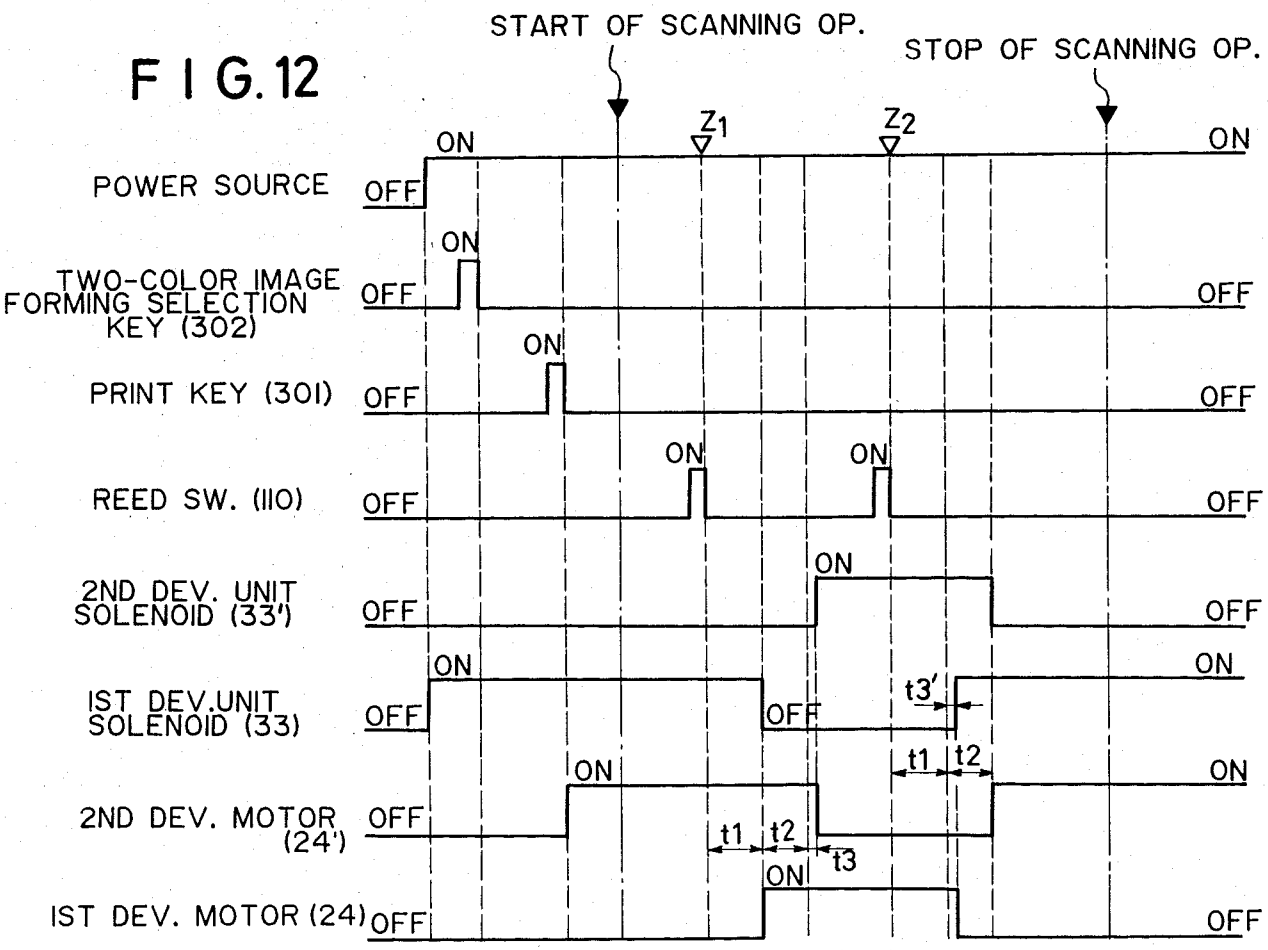
FIG. 12 is a time chart showing the sequential operation of the components of the image forming apparatus of FIG. 1 in a two-color image forming mode.
Figure 14:
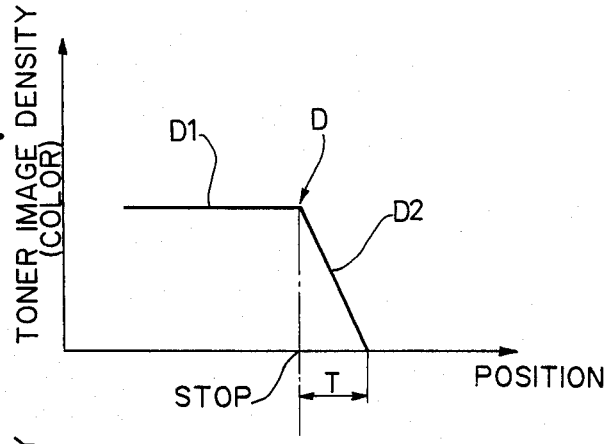
Figure 15:
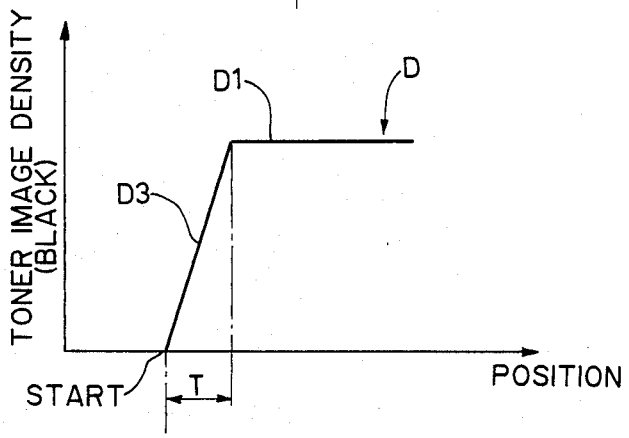
Figure 16:
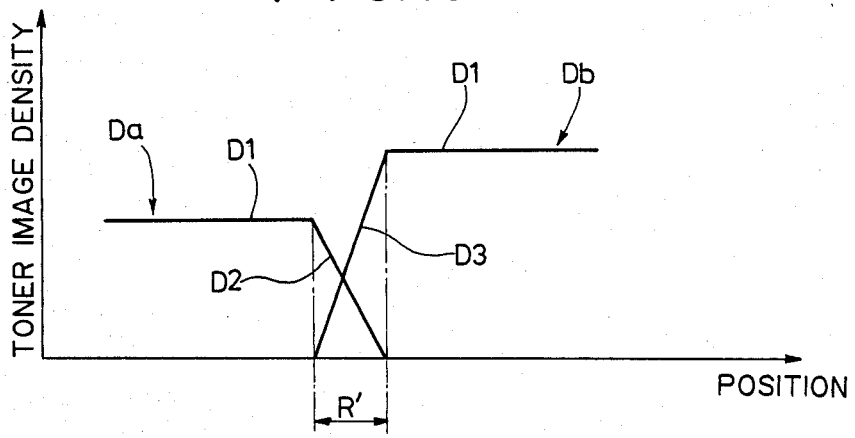
Figure 17:
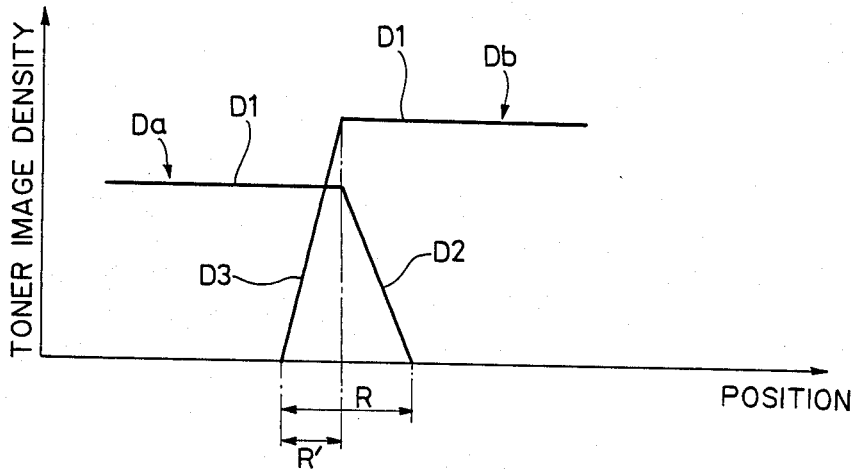
Figure 18:
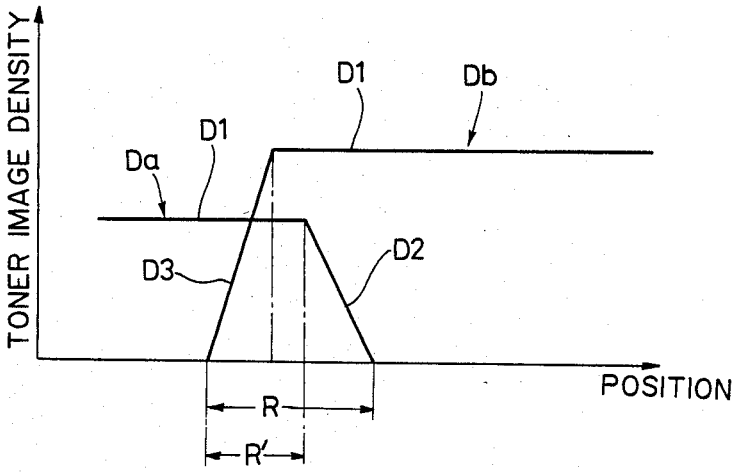

A reed switch 110 provided on the scanner 40 of the optical scanning system 3 gives signals to a control circuit shown in FIG. 11 upon the detection of the magnets 101a and 102a.

Figure 10:
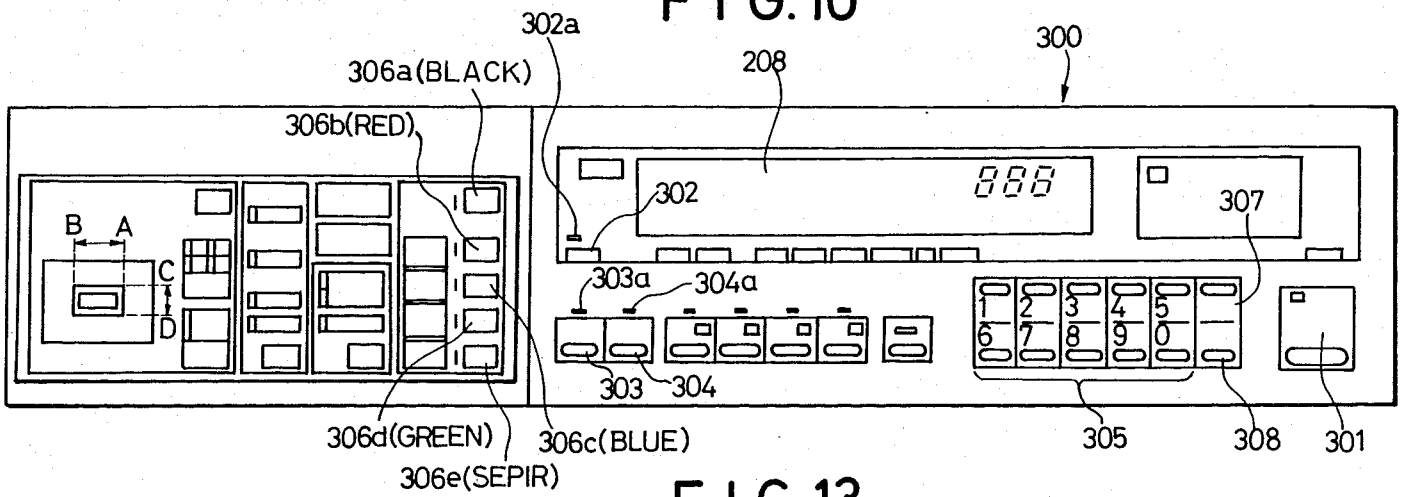
FIG. 10 is a plan view of an operating panel employed in the image forming apparatus of FIG. 1.

Operating Panel (FIG. 10)

Referring to FIG. 10, arranged on a control panel 300 are a print start key 301, a display 208 for displaying the number of copies to be produced and codes indicating troubles, a numeric key set 305, an interrupt key 307, a clear/stop key 308, a two-color image forming mode selecting key 302, a pilot LED (light emitting diode) 302a for indicating selection of the two-color image forming mode, a first developing unit selecting key 303 for selecting the first developing unit 4, a second developing unit selecting key 304 for selecting the second developing unit 5, a pilot LED 303a for indicating selection of the first developing unit 4, a pilot LED 304a for indicating selection of the second developing unit 5, toner color indicators 306a, 306b, 306c, 306d and 306e for indicating the color of toner to be used by the selected developing unit among the developing units 4 and 5.

Control Circuit (FIG. 11)

The control circuit comprises a first CPU (central processing unit) 621, a second CPU for controlling the optical scanning system 3, and a RAM (random access memory) 623. The first CPU 621 and the second CPU 622 are interconnected for synchronous control operation.

A switch matrix 207 comprising rectangular arrays of switches including switches operated by the keys provided on the operating panel 300, the developing unit detecting switched SW1 and SW2 and toner color detecting switches SW3 to SW8 is connected to the first CPU 621. The display 208, and the pilot LEDs 302a, 306a, 306b, 306c, 306d and 306e are connected through the switch matrix 207 and a decoder 206 to the first CPU 621. The output terminals A1 to A14 are connected respectively to a main motor, clutches, and motors respectively for driving the first and second developing units according to signals provided by the switches of the switch matrix 207.

A scanning motor controller 221, a stepping motor controller 202 for controlling a stepping motor for driving the lens, a limit switch SO which is operated by the scanner 40, a timing switch SI and the reed switch 110 provided on the scanner 40 are connected to the second CPU 622.

Two-color Image Forming Mode (FIGS. 12 to 18)

Operation in the two-color image forming mode will be described hereinafter. In the following description, the components of the second developing unit 5 and the associated parts will be indicated by reference numerals or characters each suffixed with a prime (') to discriminate those components from the corresponding components of the first developing unit 4.

Upon the connection of the image forming apparatus to a power source by turning on a main switch, not shown, the magnetic roller 13 of the first developing unit 4 is positioned so that the middle position between the magnetic pole $N_1$ and the magnetic pole $S_1$ is located opposite to the photosensitive drum 1 as shown in FIG. 6, and the magnetic roller 13' of the second developing unit 5 is positioned so that the magnetic pole $N_1$ is located opposite to the photosensitive drum 1 as shown in FIG. 4.

Depression of the print start key 301 automatically actuates the second developing unit 5 using the black developer for the standard copying operation. When the copying operation in the two-color image forming mode is required, the two-color image forming mode selecting key 302 must be depressed before depressing the print start key 301. Depression of the two-color image forming mode selecting key 302 during the copying operation after the print start key 301 has been depressed is invalid. If the developing units 4 and 5 are not set correctly respectively at the predetermined positions, depression of the two-color image forming mode selecting key 302 is invalid. When the depression of the two-color image forming mode selecting key 302 is valid, the copying mode is changed from the standard image forming mode to the two-color image forming mode.

Referring to FIG. 8, the first slider 101 and the second slider 102 are moved along the guide groove respectively to appropriate positions to assign the sections A and C for reproducing the image in black, and the section B for reproducing the image in a color. The function of the sliders 101 and 102 are effective only in the two-color image forming mode and is invalid in the rest of image forming modes.

After thus setting the image forming apparatus, a document S is placed on the contact glass 9 as shown in FIG. 8, and then the print start key 301 is depressed. Then, a motor 24' for driving the second developing unit 5 is actuated to rotate the developing sleeve 12', supply roller 14' and screw 15' of the second developing unit respectively in directions indicated by the arrows b, c and d, thereby the developer containing black toner is stirred and mixed by the screw 15' in the chamber 17' and is moved through the chamber 16' by the supply roller 14' toward the developing sleeve 12'. Thus, the developer is supplied to the circumference of the developing sleeve 12' by the supply roller 14' to form a magnetic brush over the circumference of the developing sleeve 12'. As the developing sleeve 12' is rotated, the height of the magnetic brush is adjusted to a predetermined height by the brush height regulating member 19' defining a brush height regulating gap Db (FIG. 4). The magnetic brush comes into contact with the circumference of the photosensitive drum 1 over a fixed width thereon to develop an electrostatic latent image formed over the circumference of the photosensitive drum 1.

Figure 13:
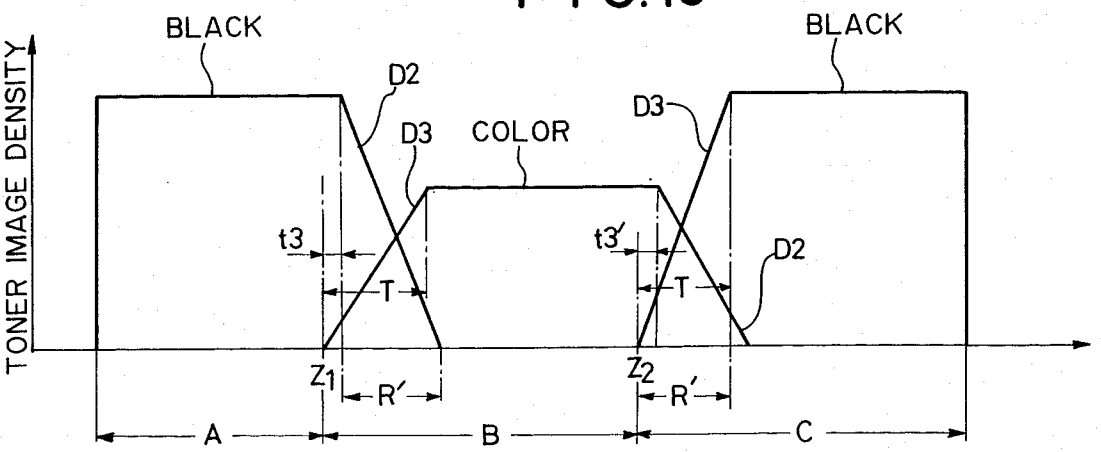
FIGS. 13 through 18 are graphs showing the variation of toner image density.

On the other hand, upon the depression of the print start key 301, the scanner 40 starts moving in the direction indicated by the arrow s (FIG. 1) for scanning operation, in which the document S placed on the contact glass 9 is illuminated and reflected light reflected by the document S is projected at the exposure position W on the circumference of the photosensitive drum 1 to form an electrostatic latent image over the circumference of the photosensitive drum 1. The electrostatic latent image is developed first by the second developing unit 5. In the developing zone X', a portion of the electrostatic latent image at the front end and in the vicinity of the front end of the electrostatic latent image comes into contact with the magnetic brush after the second developing unit 5 has become ready for function, and hence the toner image density in that portion rises rapidly (FIG. 13).

Upon the detection of the magnet 101*a* of the first slider 101 by the reed switch 110 of the scanner 40, the reed switch 110 gives a detection signal to the second CPU 622. At this moment, a portion of the electrostatic latent image corresponding to the boundary $Z_1$ between the sections A and B is located at a position corresponding to the exposure position W. Only the second developing unit 5 keeps operating further for as time $t_1$ (0.22 sec, in this embodiment) in which the boundary $Z_1$ advances from the position corresponding to the exposure position W to a position corresponding to the developing zone X of the first developing unit 4.

Upon the arrival of the boundary $Z_1$ in the electrostatic latent image at the developing zone X in the time $t_1$ after the detection of the magnet 101*a* of the first slider 101 by the reed switch 110, the first developing unit 4 is actuated and the solenoid 33 for controlling the magnet roller 13 of the first developing unit 4 is de-energized. Consequently, the first developing unit 4 is set, similarly to the second developing unit 5, in a state shown in FIGS. 4 and 5, in which the developing sleeve 12, the supply roller 14 and the screw 14 are rotated respectively in the directions indicated by the arrows b, c and d and a magnetic brush is formed over the circumference of the developing sleeve 12 to develop the electrostatic latent image formed over the circumference of the photosensitive drum 1. Thus, the color toner is applied to a portion of the electrostatic latent image corresponding to the section B.

The front and rear portions, with respect to the direction of rotation of the photosensitive drum 1, of the electrostatic latent image located in the developing zone X at the start of the first developing unit 4 are different from each other in the duration of contact with the magnetic brush. Accordingly, as shown in FIG. 13, the toner image density in the front end of the section B increases gradually through a development starting area D3 to a stable density level. In a time $t_2$ (in this embodiment, 0.2 sec) after the motor 24 for driving the first developing unit 4 has been actuated, the boundary $Z_1$ in the electrostatic latent image moves from the developing zone X to the developing zone X' of the second developing unit 5. However, the motor 24' for driving the second developing unit 5 is kept in operation, and the solenoid 33' for controlling the magnet roller 13' of the second developing unit 5 is kept de-energized when the boundary $Z_1$ in the electrostatic latent image arrives at the developing zone X'. A time $t_3$ after the arrival of the boundary $Z_1$ at the developing zone X', the motor 24' for driving the second developing unit 5 is stopped to stop the developing sleeve 12', the supply roller 14' and the screw 15' of the second developing unit 5 and the solenoid 33' is energized to set the second developing unit 5 in the state shown in FIGS. 6 and 7, in which the middle position between the magnetic poles $N_1$ and $S_1$ of the magnet roller 13' is located opposite to the photosensitive drum 1, and to terminate developing the electrostatic latent image in the section A in black.

Since the circumference of the photosensitive drum 1 carrying the electrostatic latent image is in contact with the magnetic brush always by a circumferential width during the developing operation, the toner image density falls gradually through an area D2 as shown in FIG. 13 instead of falling sharply. The time $t_3$ is determined properly within a rising time T from the start of the first developing unit 4 to the arrival of toner image density to the stable density level as shown in FIG. 13. Accordingly, a portion of the electrostatic latent image in the vicinity of the boundary $Z_1$ is developed in a mixed color, namely, a color consisting of black and a chromatic color. However, the visually sensible width R' of the portion developed in the mixed color is only in the area D2 in which the developing operation using the black developer is terminated, and hence the portion of the image in the vicinity of the boundary $Z_1$ can perfectly be reproduced.

The scanner 40 advances further and the reed switch 110 detects the magnet 102*a* of the slider 102 and gives a detection signal to the second CPU 622 upon the arrival of the scanner 40 at the boundary $Z_2$ between the sections B and C. At this moment, a portion of the electrostatic latent image corresponding to the boundary $Z_2$ arrives at the exposure position W. The portion of the electrostatic latent image corresponding to the boundary $Z_2$ arrives at the developing zone X in a time $t_1$ after the reed switch 110 has provided the detection signal. However, the motor 24 for driving the first developing unit 4 is kept in operation and the solenoid 33 for controlling the magnetic roller 13 of the first developing unit 4 remains de-energized for a time $t_3'$ after the arrival of the portion of the electrostatic latent image corresponding to the boundary $Z_2$ at the developing zone X, and then the motor 24 for driving the first developing unit 4 is stopped and the solenoid 33 of the first developing unit 4 is energized to terminate the developing operation for developing the electrostatic latent image in the section B in the color. The time $t_3'$ is determined properly within a time T from the start of the second developing unit 5 to a moment when the toner image density of the toner image developed on the photosensitive drum 1 by the second developing unit 5 increases to a stable density level. In this embodiment, the time $t_3'$ is equal to the time $t_3$. Accordingly, an initial portion of the electrostatic latent image after the boundary $Z_2$ corresponding to the time $t_3'$ is developed by the color toner and the density of the color toner image decreases through an area D2.

A time $t_1+t_2$ after the reed switch 110 has detected the magnet 102*a* of the slider 102, namely, upon the arrival of the boundary $Z_2$ in the electrostatic latent image at the developing region X' of the second developing unit 5, the motor 24' for driving the second developing unit 5 is actuated and the solenoid 33' of the second developing unit 5 is de-energized to start developing the section C of the electrostatic latent image in black. In developing the section C of the electrostatic latent image by the second developing unit 5, similarly to development of the front portion of the section B by the first developing unit 4, the front and back portions of the electrostatic latent image located in the developing zone X' at the start of the second developing unit 5 are different from each other in the duration of contact with the magnetic brush. Therefore, the black toner image density in the section C increases gradually to a stable density level instead of increasing sharply to the stable density level. Consequently, a portion of the electrostatic latent image in the vicinity of the boundary $Z_2$, similarly to the portion of the electrostatic latent image in the vicinity of the boundary $Z_1$, is developed in a mixed color, namely, a color consisting of black and the chromatic color. However, a visually sensible width R' of the portion developed in the mixed color is limited to the area D2 and the portion of the electrostatic latent image in the vicinity of the boundary $Z_2$ is reproduced perfectly.

The second developing unit 5 remains operative to develop the section C of the electrostatic latent image until the scanning operation of the scanner 40 is completed. Since development of the end of the section C of the electrostatic latent image is terminated while the second developing unit 5 is in a fully functional state, the toner image density in the end of the section C of the electrostatic latent image falls sharply.

Thus, the electrostatic latent image is developed in two colors by changing the operative developing unit from the second developing unit 5 using the black developer to the first developing unit 4 using the color developer, and then from the first developing unit 4 to the second developing unit 5 during the image forming cycle from the start to the end of the scanning operation.

Although the moment of termination of the developing operation for developing the section A before the boundary $Z_1$ and the moment of termination of the developing operation for developing the section B before the boundary $Z_2$, in this embodiment, are delayed respectively by the time $t_3$ and by the time $t_3'$ from the moment of passing the developing unit for the section after the boundary $Z_1$, namely, the section B, and the developing operation for the section after the boundary $Z_2$, namely, the section C, these moments of starting of the developing operation may be advanced respectively by the time $t_3$ and the time $t_3'$ from the moment of passing the developing unit.

Although the developing color is changed, in this embodiment, from black to the chromatic color, and then from the chromatic color to black during one scanning cycle, the color arrangement is not limited to such a color arrangement. It is also possible to demarcate the image into an optional number of sections and to reproducing the image in an optional color arrangement by providing the image sectioning mechanism with additional sliders for sectioning the image or by varying the order of operation of the developing units.

Furthermore, although the two developing units 4 and 5 are arranged by the photosensitive drum 1, in this embodiment, to reproduce the image of a document in a two-color image, it is possible to reproduce the image of a document in a three-color or four-color image by providing three or four developing units near the photosensitive drum 1.

Furthermore, in this embodiment, the motor 24 (24') for driving the developing unit 4 (5) is stopped and the magnet roller 13 (13') is turned through a predetermined angle to retract the magnetic poles from the developing zone X (X') and from a position opposite the magnetic brush height regulating member 19 (19') while the developing unit 4 (5) is kept inoperative to reduce the possibility of the contact of an undesired magnetic brush with the circumference of the photosensitive drum so that development of the electrostatic latent image in a mixed color is obviated. However, the magnetic poles of the magnet roller need not necessarily be shifted in such a manner from the operative position to the inoperative position while the developing unit is kept inoperative. It is possible to reproduce the image in a half tone by positively causing development of the image in a mixed color.

Figure 19:
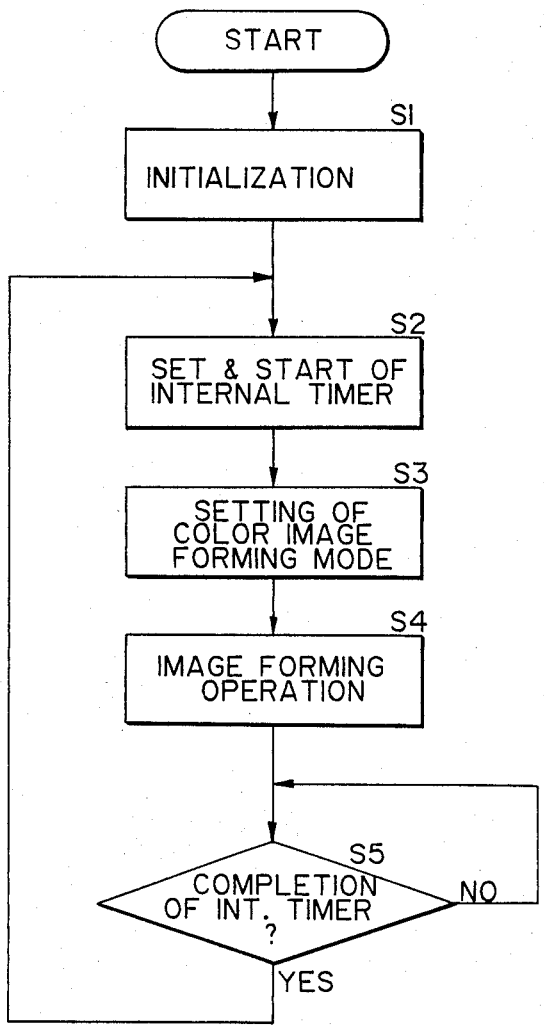
FIGS. 19 through 21 are flow charts of control procedures.
Figure 20:
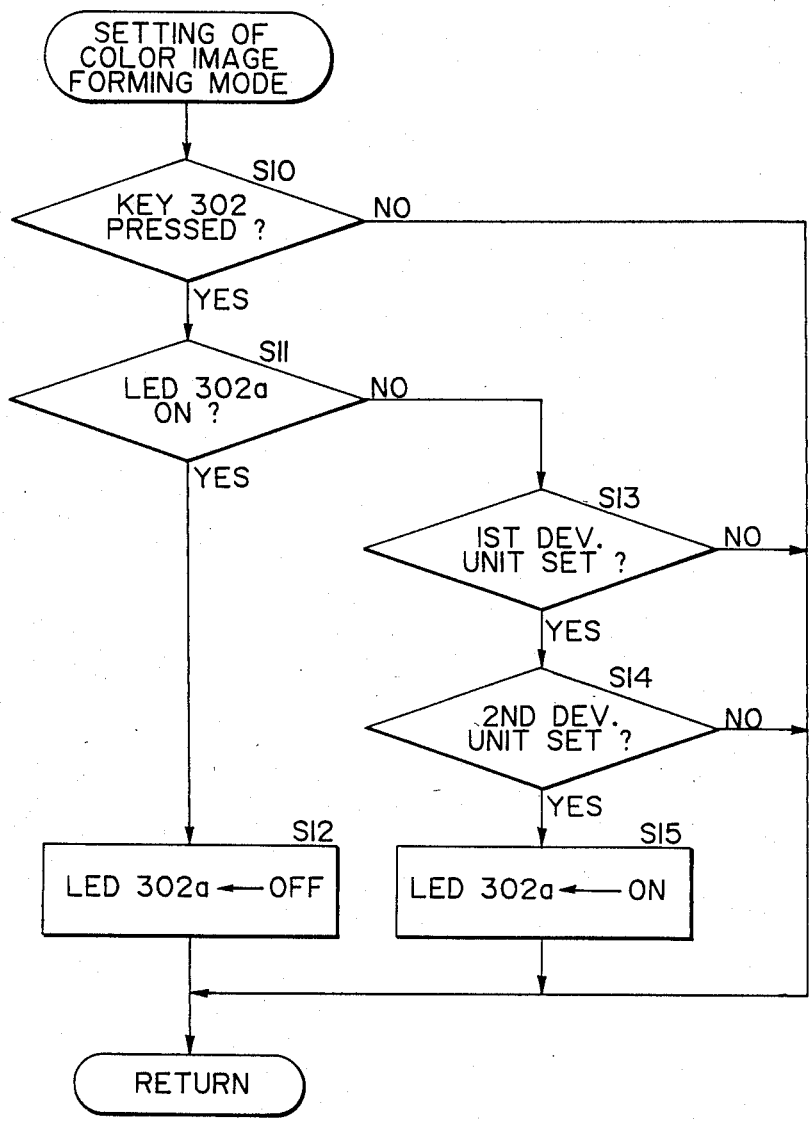
Figure 21:
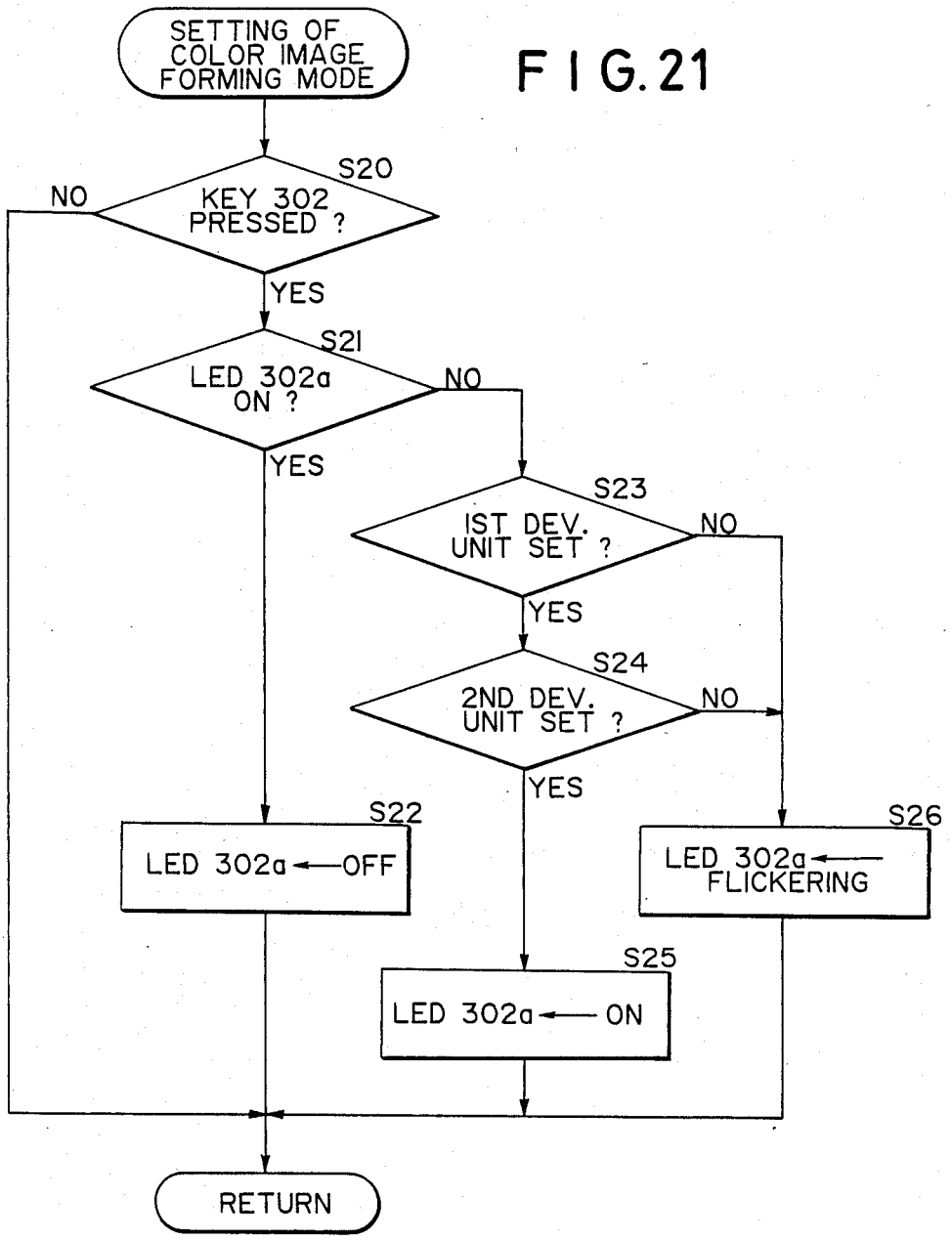

Control Procedure (FIGS. 19 to 21)

FIG. 19 shows a main control routine to be executed by the first CPU 621. The first CPU 621 is reset to start a control program. In step $S_1$, a RAM 623 is cleared, registers are initialized and the component devices of the image forming apparatus are set respectively for initial modes. An internal timer is started in step $S_2$. The internal timer defines a cycle time for the main routine, which is set in step $S_1$. The two-color image forming mode is selected in step S3 by operating the two-color image forming mode selecting key 302, and then the image forming operation is executed in step S4. After all the subroutines have been finished, a decision is made in step S5 as to whether or not the cycle time defined by the internal timer has elapsed. When the decision in step S5 is affirmative, the routine returns to step $S_2$. Timers for timing subroutines define the length of cycle time for the subroutines within the cycle time for the main routine.

FIG. 20 shows a subroutine to be executed in step S3 for selecting the two-color image forming mode by operating the two-color image forming mode selecting key 302. A decision whether or not the two-color image forming mode is selected by pressing the two-color image forming mode selecting key 302 on the operating panel 300 is made in step S10. When the decision in step S10 is affirmative, it is decided in step S11 whether or not the pilot LED 302*a* for indicating selection of the two-color image forming mode is turned on. The two-color image forming mode selecting key 302 is an alternate on-off key for alternately selecting and cancelling the two-color image forming mode. When the two-color image forming mode is selected, the decision in step S11 is "YES" and the pilot LED 302*a* is turned off and the two-color image forming mode is cancelled in step S12.

When the two-color image forming mode is not selected, namely, when the decision in step S11 is "NO", it is decided in steps S13 and S14 whether or not the developing units 4 and 5 are set respectively at the predetermined positions When the decisions in both steps S13 and S14 are affirmative, the pilot LED 302*a* is turned on and the image forming apparatus is set for the two-color image forming mode in step S15. When the developing units 4 and 5 are not set respectively at the predetermined positions, the two-color image forming mode selecting subroutine is ended. Thus, both the developing units 4 and 5 must be set at the predetermined position for the two-color image forming mode, or selection of the two-color image forming mode is invalid.

FIG. 21 shows another two-color image forming mode selecting subroutine, which basically is the same as the subroutine shown in FIG. 20. When a decision is made through steps S23 and S24 that neither the developing unit 4 nor 5 is set at the predetermined position, the pilot LED 302*a* is caused to flicker in step S26 to notify the operator of the invalidness of selection of the two-color image forming mode.

Although both the first developing unit 4 and the second developing unit 5, in this embodiment, are removable, it is also possible to mount the second developing unit 5 fixedly on the frame and to mount only the first developing unit 4 removably on the frame. In such a case, step S14 of the subroutine shown in FIG. 20 and step S24 of the subroutine shown in FIG. 21 are omitted.

If the first developing unit 4 or the second developing unit 5 is removed in the two-color image forming mode, the pilot LED 302*a* may be turned off and the two-color image forming mode may be cancelled, or the pilot LED 302*a* may be caused to flicker to notify the operator of removal of the first developing unit 4 or the second developing unit 5.

Although the present invention has been described as applied to an image forming apparatus having two developing units, the present invention is not limited thereto in application and may be applied to an image forming apparatus having three of more developing units. In an image forming apparatus having three or more developing units, selection of the two-color image forming mode is possible only when at least two developing units are mounted on the frame of the image forming apparatus respectively at predetermined positions.

As apparent from the foregoing description, according to the present invention, selection of the two-color image forming mode is inhibited when at least two developing units are not mounted on the frame of the image forming apparatus respectively at predetermined positions. Accordingly, the present invention prevents erroneous image forming operation in the two-color image forming mode when only one developing unit is mounted on the frame of the image forming apparatus and improves the accessibility of the image forming apparatus.

Having described our invention as related to the embodiment shown in the accompanying drawing, it is our intention that the invention be not limited by any of the details of description, unless otherwise specified, but rather be construed broadly within its spirit and scope as set out in the accompanying claims.

What is claimed is:

1. An image forming apparatus capable of forming a multicolor image, comprising:
   - a frame;
   - a photosensitive member provided on the frame;
   - a first developing unit removably mounted on the frame for developing a latent image formed over the surface of the photosensitive member by using a first color toner;
   - a second developing unit removably mounted on the frame for developing a latent image formed over the surface of the photosensitive member by using a second color toner;
   - detecting means for detecting the positional condition of the first and second developing units;
   - image forming mode selecting means for selecting a desired image forming mode among a first image forming mode in which a single-color image is formed by operating one of said first developing unit and said second developing unit, and a second image forming mode in which a two-color image is formed by operating both said first developing unit and said second developing unit; and
   - control mean which enables selection of the second image forming mode when the appropriate disposition of both the first and second developing units on the frame is detected by the detecting means, and inhibits selection of the second image forming mode when the appropriate disposition of only one of the first and second developing units is detected by the detecting means.

2. An image forming apparatus according to claim 1, wherein said detecting means are switches which are provided on said frame and give detection signals to said control means upon the detection of correct disposition of said first and second developing units on said frame, respectively.

3. An image forming apparatus according to claim 1, wherein said image forming mode selecting means are pushbutton switches which are provided on an operating panel and give image forming mode selection signals indicating selected image forming modes to said control means, respectively.

4. An image forming apparatus according to claim 1, wherein said control means is a microprocessor which sets the second image forming mode upon the reception of a second image forming mode selection signal from said image forming mode selecting means when detection signals indicating correct disposition of said first and second developing units on said frame are applied thereto by said detecting means.

5. An image forming apparatus capable of forming a multicolor image, comprising:

a frame;

a photosensitive member provided on the frame;

a plurality of developing units removably mounted on the frame an adapted for developing a latent image formed over the surface of the photosensitive member respectively by using different color toners;

detecting means for detecting the positional condition of the developing units mounted on the frame;

image forming mode selecting means for selecting a desired image forming mode among a first image forming mode in which a single-color image is formed by operating one of said first plurality of developing units, and a second image forming mode which a multi-color image is formed by operating at least two of said developing units; and control means which enables selection of the second image forming mode when the appropriate disposition of the plurality of developing units on the frame is detected by the detecting means, and inhibits selection of the second image forming mode when appropriate disposition of only one of the plurality of developing unit on the frame is detected by the detecting means.

6. A image forming apparatus according to claim 5, wherein said detecting means are switches which are provided on said frame so as to correspond respectively to said plurality of developing units and give detection signals to said control means when the corresponding developing units are disposed correctly on said frame, respectively.

7. An image forming apparatus according to claim 5, wherein said image forming mode selecting means are pushbutton switches which are provided on an operating panel and give image forming mode selection signals indicating selected image forming modes to said control means, respectively.

8. An image forming apparatus according to claim 5, wherein said control means is a microprocessor which sets the second image forming mode upon the reception of a second image forming mode selection signal from said image forming mode selecting means when detection signals indicating correct disposition of the plurality of developing units on said frame are applied thereto by said detecting means.

9. A image forming apparatus capable of forming a multicolor image, comprising:

a frame;

a photosensitive member provided on the frame;

a first developing unit removably mounted on the frame for developing a latent image formed over the surface of the photosensitive member by using a first color toner;

a second developing unit removably mounted on the frame for developing a latent image formed over the surface of the photosensitive member by using a second color toner;

detecting means for detecting the positional condition of the first and second developing units on the frame;

image forming mode selecting means for selecting a desired image forming mode among a first image forming mode in which a single-color image is formed by operating one of said first developing unit and said second developing unit, and a second image forming mode in which a two-color image is formed by operating said first developing unit and said second developing unit; and alarm signal generating means which generates an alarm signal indicating the invalidness of selection of the second image forming mode when the detecting means detects correct disposition of only either the first or second developing unit.

10. An image forming apparatus according to claim 9, wherein said alarm signal generating means is a pilot LED device provided on an operating panel.

11. An image forming apparatus capable of forming a multicolor image, comprising:

a frame;

a photosensitive member provided on the frame;

a plurality of developing units removably mounted on the frame for developing a latent image formed over the surface of the photosensitive drum respectively by using different color toners;

detecting means for detecting the positional condition of the developing units mounted on the frame;

image forming mode selecting means for selecting a desired image forming mode among a first image forming mode in which a single-color image is formed by operating one of said plurality of developing units, and a second image forming mode in which a multi-color image is formed by operating at least two of said plurality of developing units; and alarm signal generating means which generates an alarm signal indicating the invalidness of selection of the second image forming mode when correct disposition of only one of the plurality of developing units on the frame is detected by the detecting means.

12. An image forming apparatus according to claim 11, wherein said alarm signal generating means is a pilot LED device provided on an operating panel.

13. An image forming apparatus capable of forming a multicolor image, comprising:

a frame;

a photosensitive member provided on the frame;

image forming means for forming a latent image by scanning an original document;

a first developing anti removably mounted on the frame for developing a latent image formed over the surface of the photosensitive member by using a first color toner;

a second developing unit removably mounted on the frame for developing a latent image formed over the surface of the photosensitive member by using a second color toner;

detecting means for detecting the positional condition of the first and second developing units;

image forming mode selecting means for selecting a desired image forming mode among a first image forming mode in which a single-color image is formed by the operation of one of said first developing unit and said second developing unit, and a second image forming mode in which a two-color image is formed by switching the operation of said first developing unit to the operation of said second developing unit during one scanning operation; and control means which enable selection of the second image forming mode when the appropriate disposition of both the first and second developing units on the frame is detected by the detecting means, and inhibits selection of the second image forming mode when the appropriate disposition of only one of the first and second developing units is detected by the detecting means.

* * * * *